United States Patent [19]

Guendling, Jr.

[11] Patent Number: 4,605,228

[45] Date of Patent: Aug. 12, 1986

[54] METHOD OF PUTTING A GOLF BALL

[76] Inventor: Fred W. Guendling, Jr., 199-4 Center St., Box 443, Mokena, Ill. 60448

[21] Appl. No.: 728,016

[22] Filed: Apr. 29, 1985

Related U.S. Application Data

[62] Division of Ser. No. 490,285, May 2, 1983, Pat. No. 4,523,758.

[51] Int. Cl.[4] ..... A63B 53/00

[52] U.S. Cl. ..... 273/77 R; 273/167 A; 273/80 C

[58] Field of Search ..... 273/81 B, 77 B, 77 A; 273/80 C, 80 A, 80 R, 80.2–80.9, 167 A, 168, 193 R, 167 K, 169, 183 D, 80 B, 167 G, 186 R, 81 B, 77 B, 77 A

[56] References Cited

U.S. PATENT DOCUMENTS 3,574,349 4/1971 Kropp ..... 273/81 B 4,523,758 6/1985 Guendling ..... 273/77 B

FOREIGN PATENT DOCUMENTS 14812 of 1896 United Kingdom ..... 273/77 B

*Primary Examiner*—George J. Marlo

*Attorney, Agent, or Firm*—Ernest Kettelson

[57] ABSTRACT

A method of putting a golf ball by selecting a putter club with a shaft which can be held vertically in the same vertical plane as the vertical midline of a golf ball in position for putting toward the cup and a selected aiming point which is between the ball and the cup in a selected path of travel which is intended to enable the ball to roll into the cup, holding such club shaft at one side in such vertical position with only the hand on that side gripping said club shaft, facing forward in the direction of the said selected path of travel, swinging said club in a way whereby said shaft thereof remains substantially in said vertical plane throughout said swing, and striking said golf ball with that portion of the striking surface of its club head which is in line with the axis of said club shaft impacting against the golf ball at its said vertical midline which lies in said vertical plane to cause the ball to roll along the selected path of travel until it passes over said selected aiming point and continues on toward the cup.

2 Claims, 4 Drawing Figures

METHOD OF PUTTING A GOLF BALL

RELATED APPLICATIONS

This application is a division of co-pending application Ser. No. 490,285, filed May 2, 1983, now U.S. Pat. No. 4,523,758.

BACKGROUND OF THE INVENTION

This invention relates to the field of golf clubs used as putters.

There are of course numerous different kinds of putters known to the prior art. All golfers are attempting to find the ultimate putter. Representative samples of prior art putters which have attempted to overcome the various problems in putting include those disclosed in the following U.S. patents: No. 4,369,974 which discloses a putter having a translucent head and opacified sides to help align the striking face of the putter with the ball and the intended path toward the cup; No. 4,209,172 discloses a putter head having alignment lines marked thereon to help the golfer line up with the cup; No. 4,163,554 discloses a putter for putting in a modified croquet style; No. 4,147,357 discloses a putter head having means to center it with respect to the ball; No. 4,063,733 discloses a putter in which the shaft is connected forward of the center of gravity of the head so when it strikes the ball the putter head does not tend to slant but hits the ball square with the plane of the striking surface perpendicular to the horizontal axis of the ball; No. 3,176,987 discloses a golf club putter in which the center line of the shaft is in coaxial alignment with the striking face of the putter head; No. 2,843,384 discloses a putter head which has a sloping bottom or sole which slants upwardly from the striking surface to the rear of the putter head to prevent the putter head from being dragged over the ground while stroking the ball and thus prevent interference with the forward swinging of the club head.

Some of the putters disclosed in the foregoing patents and in the prior art do not appear to meet all of the requirements and rules of the United States Golf Association. Others would be difficult and awkward to use with one hand, which is a desirable way of putting since the golfer does not have to worry about the other hand taking over which can cause the club head to skew as it strikes the ball. It eliminates the problems of remembering the correct position for the hands gripping the club, correct position for arms, elbows and shoulders since by using only one hand the wrist action becomes more mechanical and straight forward enabling the golfer to strike the ball at closer to a perpendicular line relative to the horizontal axis of the ball, or in other words to strike the ball "square on," in the direction of the intended pathway to the cup. The putter in accordance with the present invention is well adapted to be used with only one hand.

The putter in accordance with the present invention comprises a club head having a striking surface which is substantially parallel to the axis of the club shaft, and is connected to the shaft at its midpoint or centerline. While the sole of the club head is at an acute angle of about 80 degrees or less to the axis of the shaft, it terminates at an intermediate point between the heel and the toe of the club head starting from the back of the heel leaving an upwardly sloping bottom surface from the terminating point of the sole to the outermost and upper portion of the toe of the club head. This configuration enables the golfer to hold and swing the shaft of the club in a plane that is perpendicular to the ground, and in which plane the intended path of travel lies for the ball to follow on its way to the cup. When the club is held perpendicular to the ground in this way, the sole of the club head is at an acute angle to the surface of the ground as is the sloping surface of the lower edge of the club head which extends from the termination of the sole upwardly toward the outermost and upper portion of the toe. The portion of the striking surface of the club head which strikes the ball when the club shaft is held and swung perpendicular to the ground as described is the midpoint of the striking surface. Since the striking surface of the putter head is substantially parallel to the axis of the shaft, at the moment of impact the axis of the putter shaft and the striking surface of the putter head are both straight up and down or vertical whereby the ball is struck by the striking surface of the putter head at a right angle to the horizontal axis of the ball.

Putting with the putter in accordance with this invention using only one hand enables a pendulum like motion, one movement back and forth whereby the golfer can keep sight of three important aspects of putting, (1) moving the putter straight back with the striking surface of the club head positioned square with the ball, (2) only moving his eyes from the ball to the cup, and (3) sighting the spot selected for the ball to roll through on the path selected for travel to the cup. The golfer can readily take a practice free arm swing to see instantly if the striking surface of the putter head is on target, and when it is he can strike the ball without any pushes or pulls. With the putter in accordance with the present invention, the golfer has the feel of the ball because his hand is right where the impact is, the shaft being aligned with the midpoint of the club head and the ball being struck at the midpoint of the striking surface or face of the club.

SUMMARY OF THE INVENTION

It is an object of the invention to provide a putter having a club head with a planar striking surface which is substantially parallel to the longitudinal axis of the club shaft, the club shaft being connected to the club head at its midpoint or centerline.

It is an object of the invention to provide a putter having a club head comprising a heel at one side edge, a toe at the opposite side edge and a sole along the bottom edge extending from the heel toward the toe and terminating at an intermediate point between said heel and said toe, an upwardly sloping portion of the bottom edge extending from the termination point of the sole to the outermost edge of said toe, and a club shaft connected to said club head at its midpoint extending at an acute angle of about 80 degrees or less to a reference line above and parallel to the sole.

It is an object of the invention to provide a putter which can be used with one hand to swing through an arc in a substantially vertical plane which bisects the ball, the club head and the shaft, as well as the aiming spot through which the ball is to travel on the path selected toward the cup.

DESCRIPTION OF PREFERRED EMBODIMENT

Figure 1:
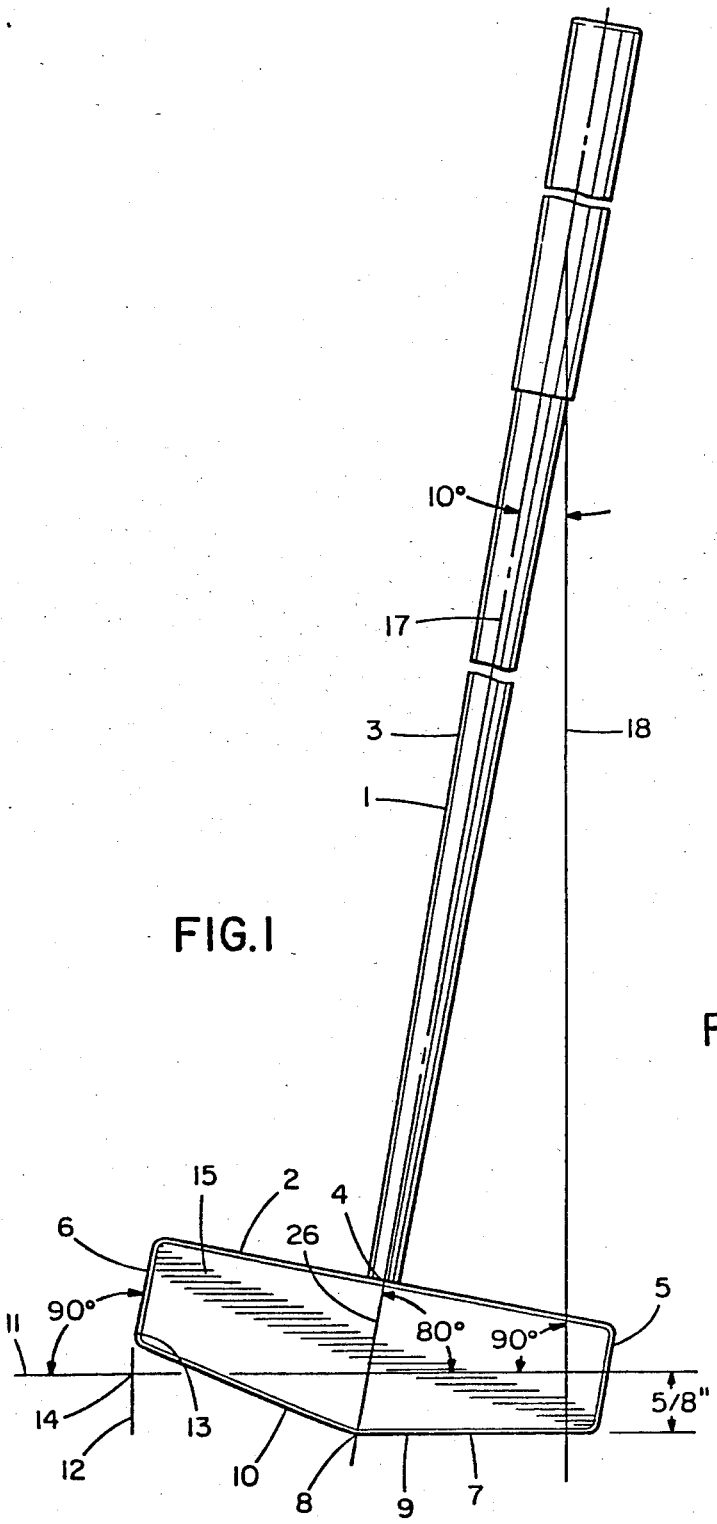
FIG. 1 is a front elevation view of a putter in accordance with this invention, showing a first reference line parallel with the sole of the club head, a line representing the longitudinal axis of the club shaft, and a second reference line extending from the toe of the club head intersecting the first reference line at a right angle.

A golf club 1 for putting, comprising a club head 2 and a club shaft 3, connected to the club head 2 at its midpoint or centerline 4.

The club head includes a heel 5 at one side edge, a toe 6 at the opposite side edge, and a sole 7 extending from the bottom of the heel 5 toward the toe 6 and terminating at an intermediate point 8 along the bottom surface 9 of the club head 2. An upwardly sloping bottom edge 10 extends from the termination of the sole 7 at intermediate point 8, sloping upwardly and extending to the toe 6 at the side of the club head opposite from the heel 5.

Figure 2:
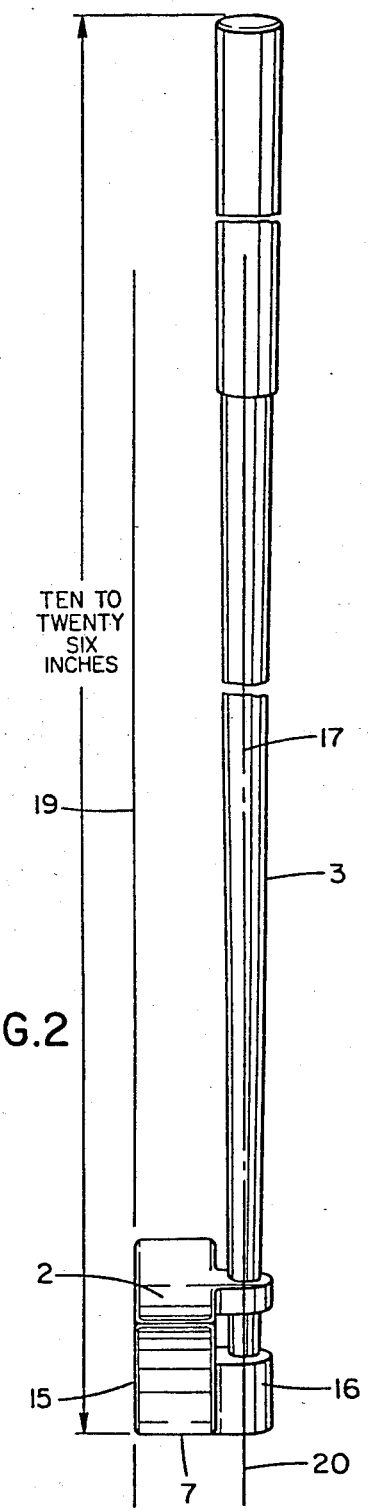
FIG. 2 is a side elevation view of the putter in FIG. 1, showing a first plane in which the striking surface of the club head lies and a second plane in which the longitudinal axis of the club shaft lies.

A first reference line 11 is shown in FIG. 1 parallel to the sole 7 and spaced five-eighths of an inch above the sole, extending from the back of the heel 5 to the end of the toe 6 represented by a second reference line 12 extending from the outermost portion 13 of the toe 6 and intersecting the first reference line 11 at a right angle at 14. As can be seen by comparing FIG. 1 with FIG. 2, the distance between the striking surface 15 of the club head and the back 16 of the club head as seen in FIG. 2 is less than the distance between the heel 5 and the toe 6 as seen in FIG. 1. The club head is thereby in compliance with Rule 2(c) of the United States Golf Association regarding shape of the head. That rule provides that the length of the club head shall be greater than the breadth, and that length shall be determined on a horizontal line, five-eighths of an inch above the sole, from the back of the heel to the end of the toe or vertical projection thereof, and that breadth shall be determined on a horizontal line between the outermost points on the face and the back of the head or vertical projections thereof.

The first reference line 11 is horizontal when the sole 7 of the club head is lying flat on the ground, and the second reference line 12 is vertical to the ground at such time.

The position of the shaft 3 in relation to the club head 2 is also in compliance with Rule 2(e) of the United States Golf Association regarding putters. The longitudinal axis 17 of the shaft 3 as shown in FIG. 1 diverges from the vertical by at least ten degrees as shown by a third reference line 18 which intersects the first reference line 11 at a right angle as can be seen in FIG. 1. Since reference line 11 is horizontal to the ground when the sole 7 is resting flat on the ground, reference line 18 which intersects reference line 11 at a right angle is therefore at the vertical to the ground at such time as the club shaft 3 angles toward such vertical line 18 from its midpoint connection to the club head 2. The shaft's longitudinal axis 17 intersects the vertical line or reference line 18 at a ten degree angle as shown in FIG. 1, thereby meeting this requirement of Rule 2(e) relating to putters. The longitudinal axis 17 of the shaft 3 also intersects the horizontal reference line, or reference line 11 to form the third angle of the reference triangle, such third angle being eighty degrees when the angle of intersection of the shaft axis 17 with the vertical reference line 18 is ten degrees, and the angle of intersection of the vertical reference line 18 with the horizontal reference line 11 is ninety degrees or a right angle.

As shown in FIG. 2, the striking surface 15 of the club head lies in a first plane indicated by the reference number 19, and the longitudinal axis 17 of the shaft 3 lies in a second plane indicated by the reference number 20 which is spaced apart from and substantially parallel to the first plane 19.

Figure 3:
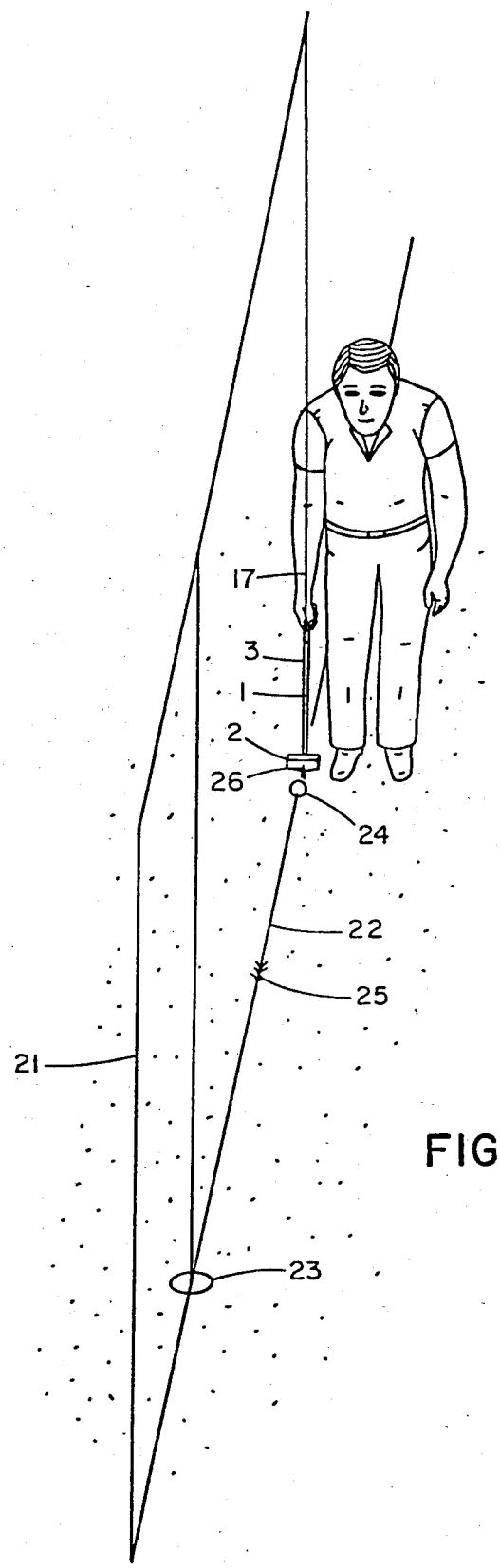
FIG. 3 is a perspective view of a golfer holding a putter in accordance with this invention lined up for putting a golf ball through an aiming point to the cup, showing a vertical plane with the shaft of the putter, the midline of the putter head, the midline of the ball, the aiming point and the starting path of travel between the ball and aiming point all lying in the same vertical plane.
Figure 4:
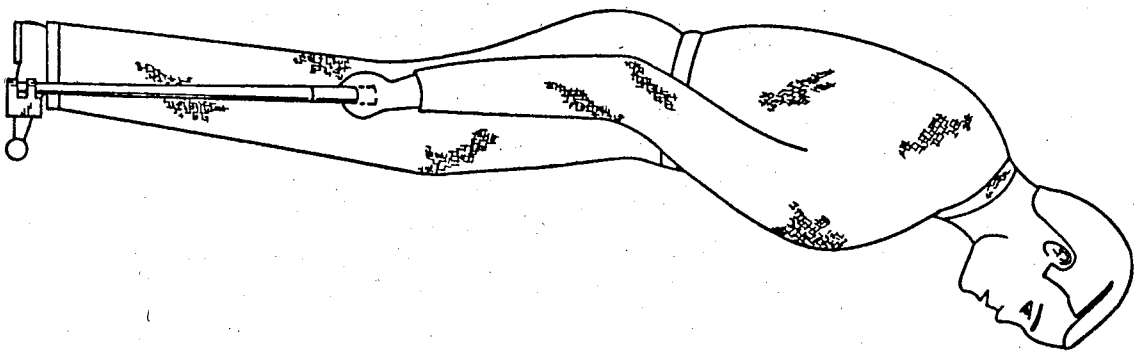
FIG. 4 is a side elevation view of the golfer in FIG. 3 and the club shaft terminating at the knees.

FIG. 3 illustrates a golfer using the putter in accordance with this invention. The golfer is able to hold and swing the shaft 3 of the club 1 in a vertical plane 21 that is perpendicular to the ground, and in which the intended pathway 22 to the cup 23 lies, as well as the vertical midline of the golf ball 24, the midline of the club head 2, and the longitudinal axis 17 of the club shaft 3. An aiming point 25, such as a particular clump or blade of grass also lies in the vertical plane 21, for the golfer to sight on as the direction in which to stroke the ball 24 and thereafter follow the contour of the green on its pathway to the cup 23.

The length of the shaft 3 may vary, but it may be relatively short since it is designed for use with only one hand and need not provide room for both hands to grasp the grip portion. The shaft 3 may extend up as far as approximately knee height when the club head is resting on the ground, but it may extend only up to about midway to the knee depending on the preference of the golfer and what each golfer feels most comfortable with. A convenient length of the club shaft 3 is between ten inches and twenty-six inches.

The planar striking surface 15 of the club head 2 includes a striking point 26 thereon at which the golf ball 24 is to be hit during the putting stroke, which striking point is in line with longitudinal axis 17 of the club shaft 3.

I claim:

1. A method of putting a golf ball, comprising the steps of selecting a putting club having a shaft which can be held vertically in the same vertical plane as the vertical midline of a golf ball in position for putting toward the cup and a selected aiming point which is between the ball and the cup in a selected path of travel which is intended to enable the ball to roll into the cup, holding such club shaft at one side in such vertical position with only the hand on that side gripping said club shaft, facing forward in the direction of the said selected path of travel with the hand on the opposite side free, swinging said club with said one hand in a way whereby said shaft thereof remains substantially in said vertical plane throughout said swing, and striking said golf ball with that portion of the striking surface of its club head which is in line with the axis of said club shaft impacting against the golf ball at its said vertical midline which lies in said vertical plane to cause said ball to roll along said selected path of travel substantially in said vertical plane until it passes over said selected aiming point.

2. A method of putting a golf ball as set forth in claim 1, including the additional steps of obtaining a putting club which also includes a planar striking surface on its club head which lies in a first plane and a shaft whose longitudinal axis lies in a second plane substantially parallel to said first plane, and while holding said putting club with only said one hand striking said golf ball at the point in said swing at which said planar striking surface of said club head and said club shaft are both substantially perpendicular to the ground in addition to being substantially in said vertical plane in which the vertical midline of said golf ball and said selected aiming point lie.

* * * * *